US010515619B1

(12) United States Patent
Chang et al.

(10) Patent No.: US 10,515,619 B1
(45) Date of Patent: Dec. 24, 2019

(54) PORTABLE SMART ELECTRONIC DEVICE FOR NOISE ATTENUATING AND AUDIO BROADCASTING

(71) Applicant: Chung Yuan Christian University, Taoyuan (TW)

(72) Inventors: Cheng-Yuan Chang, Taoyuan (TW); Sen-Maw Kuo, Taoyuan (TW)

(73) Assignee: Chung Yuan Christian University (TW)

( * ) Notice: Subject to any disclaimer, the term of this patent is extended or adjusted under 35 U.S.C. 154(b) by 0 days.

(21) Appl. No.: 16/401,323

(22) Filed: May 2, 2019

(30) Foreign Application Priority Data

Apr. 2, 2019 (TW) ..... 108111687 A

(51) Int. Cl.

| | |
|---|---|
| ***H04R 3/02*** | (2006.01) |
| ***G10K 11/175*** | (2006.01) |
| ***A47G 9/10*** | (2006.01) |
| ***G10K 11/00*** | (2006.01) |
| *A47G 9/00* | (2006.01) |

(52) U.S. Cl.
CPC ..... *G10K 11/175* (2013.01); *A47G 9/10* (2013.01); *G10K 11/002* (2013.01); *A47G 2009/006* (2013.01)

(58) Field of Classification Search
CPC ..... G10K 11/175; G10K 11/002; A47G 9/10
See application file for complete search history.

(56) References Cited

U.S. PATENT DOCUMENTS

| | | | | |
|---|---|---|---|---|
| 5,133,017 | A * | 7/1992 | Cain | G01R 33/3854 381/71.6 |
| 5,844,996 | A * | 12/1998 | Enzmann | A61B 5/7475 381/71.6 |
| 8,325,934 | B2 * | 12/2012 | Kuo | A47C 21/003 381/66 |
| 2001/0031052 | A1 * | 10/2001 | Lock | H04R 5/023 381/71.7 |
| 2011/0007907 | A1 * | 1/2011 | Park | G10K 11/178 381/71.8 |
| 2014/0086425 | A1 * | 3/2014 | Jensen | G10K 11/17854 381/71.11 |
| 2016/0055842 | A1 * | 2/2016 | DeFranks | A47G 9/10 381/66 |
| 2017/0053637 | A1 * | 2/2017 | DeFranks | A47G 9/10 |
| 2019/0103090 | A1 * | 4/2019 | Cho | G10K 11/178 |
| 2019/0139534 | A1 * | 5/2019 | Kubota | G10K 11/17819 |

* cited by examiner

*Primary Examiner* — Simon King

(57) ABSTRACT

Disclosures of the present invention describe a portable smart electronic device, which consists of several first reference microphones, a first loudspeaker, a first error microphone, several of second reference microphones, a second loudspeaker, a second error microphone, and a noise controlling module. Both the first error microphone and the second error microphone are set to have a noise detection direction and face to a first region near to a right ear and a second region near to a left ear, respectively. Therefore, the noise detection direction and an audio broadcasting direction of both the first loudspeaker and the second loudspeaker have a same progress direction. By such arrangement, this portable smart electronic device can be operated to adaptively provide an anti-noise audio to the first region and the second region for establishing a quiet zone in both the two regions by attenuating various environment noises.

9 Claims, 6 Drawing Sheets

PORTABLE SMART ELECTRONIC DEVICE FOR NOISE ATTENUATING AND AUDIO BROADCASTING

BACKGROUND OF THE INVENTION

1. Field of the Invention

The present invention relates to the field of sleep noise attenuating technologies, and more particularly to a portable smart electronic device for noise attenuating and audio broadcasting.

2. Description of the Prior Art

Snoring is an acoustic phenomenon generated by vibrating tissue structures due to obstruction in the upper airway during sleep, and snoring is common in most of people. U.S. National Commission on Sleep Disorders Research estimates that 74 million Americans snore every night, and 38% of Americans who are disturbed by snoring, suffer from daytime fatigue. The annoying intermittent nature of snoring disrupts the sleep of the snorer's bed partner, causing stress and social nuisance. This can result in loss of productivity in the work environment and lead to occupational accidents.

Besides the sound noise made by snoring, continuously-increasing traffic noises coming from flight and ground vehicles have become principal noise sources that seriously affect people's sleeping. On the other hand, the growth of high-density housing increases the exposure of populations to traffic noise sources, and the cost constraints have resulted in a tendency to use lighter materials for automobile and building, which results in the reduction of the noise resistance of people's house.

Accordingly, U.S. Pat. No. 8,325,934 discloses an electronic pillow for abating snoring and environmental noises in order to enhance the sleeping quality of a user. FIG. 1 shows a block diagram of the electronic pillow disclosed by U.S. Pat. No. 8,325,934. The electronic pillow comprises: a pillow 12', a controller unit 14' and a reference sensing unit 16'. FIG. 2 shows a top view of the conventional electronic pillow. From the disclosures of U.S. Pat. No. 8,325,934, it is understood that the reference sensing unit 16' has at least one reference microphone for collecting undesired noises including snoring noise and environment noises. On the other hand, the controller unit 14' is configured for having a specific function of active noise controlling (ANC). By such arrangement, the controller unit 14' is able to correspondingly generate an anti-noise signal after receiving a reference sensing signal, and then transmits the anti-noise signal to two loudspeakers 22' disposed in the pillow 12', thereby broadcasting an anti-noise audio (sound) by the loudspeakers 22' to abating (or canceling) snoring and environmental noises. It is noted that, there are two error microphones 20' encased by the pillow 12', wherein each of the two error microphones 20' is positioned to be close to one ear of a user as shown in FIG. 2. The error microphones 20' detect various signals or noises created by the user and relay these signals to the controller unit 14' for processing.

From FIG. 2, it can easily find that the loudspeakers 22' are disposed in the pillow 12', so as to broadcast the anti-noise audio by an upward direction instead of directly toward the user's ears. It is foreseeable that, there are merely a few parts of the anti-noise sound transmitted to near the user's ears for use in completing the noise attenuation. As a result, most of the undesired noises would not be abated (or canceled) by the anti-noise sound broadcasted from the loudspeakers 22'. In addition, the disclosures of U.S. Pat. No. 8,325,934 further emphasize that the reference microphone of the reference sensing unit 16' is disposed on any one object that is possible to make or produce noise. For example, the reference microphone can be placed directly on a bedroom door for collecting switching noises produced by the bedroom door under door opening and door closing progresses. However, it is worth noting that, placing the reference microphone of the reference sensing unit 16' on the bedroom door not only causes a whole volume of the electronic pillow be too large, but also leads the electronic pillow to be inconvenient for the user to carry on. On the other hand, it can also be foreseeable that the reference sensing unit 16' may not collect the right reference signal in the case of the fact that the principal noises coming from other orientations instead of the bedroom door. In such case, the electronic pillow fails to completely show its noise abating function.

From above descriptions, it is understood that, when designing the electronic pillow for use in abating snoring and environmental noises, it is not only the relatively installing positions of the reference microphone 16', the loudspeakers 22' and the error microphones 20' must be fully considered so as to have a proper arrangement, the applications and the portability of the electronic pillow does also need to be well considered. It is easy to know that, the electronic pillow disclosed by U.S. Pat. No. 8,325,934 lacks the portability because the controller unit 14', the error microphone 20', and the two loudspeakers 22' are all encased in the by the pillow 12'. Moreover, such design also causes the applications of the electronic pillow be largely limited.

From above descriptions, it is clear that there is still room for improvement in the structural design of the conventional electronic pillow. In view of that, inventors of the present application have made great efforts to make inventive research and eventually provided a portable smart electronic device for noise attenuating and audio broadcasting.

SUMMARY OF THE INVENTION

The primary objective of the present invention is to disclose a portable smart electronic device for noise attenuating and audio broadcasting, which mainly comprises: a first housing body, a plurality of first reference microphones, a first loudspeaker, a first error microphone, a second housing body, a plurality of second reference microphones, a second loudspeaker, a second error microphone, and a noise controlling module. Particularly, both the first error microphone and the second error microphone are set to have a noise detection direction and face to a first region near to a right ear and a second region near to a left ear, respectively. Therefore, the noise detection direction and an audio broadcasting direction of both the first loudspeaker and the second loudspeaker have a same progress direction. By such arrangement, this portable smart electronic device can be operated to adaptively provide an anti-noise audio to the first region and the second region so as to establish a quiet zone in both the two regions by attenuating various environment noises.

It is worth further explaining that, after integrating the noise controlling module into an electronic device, this novel portable smart electronic device for noise attenuating and audio broadcasting can further possesses several advanced functions, including snore cancellation, abating environment noises, noise masking, sleep apnea detection, sleeping quality detection, acoustic echo cancelation, double talk detection (DTD), voice control, and audio integration.

In order to achieve the primary objective of the present invention, the inventor of the present invention provides an embodiment for the portable smart electronic device for noise attenuating and audio broadcasting, which is connected to an object, and comprises:

a first housing body;

a plurality of first reference microphones, being disposed in the first housing body, and the plurality of first reference microphones are respectively exposed out of different sides of the first housing body by one microphone head thereof;

a first loudspeaker, being disposed in the first housing body and having a first audio broadcasting side that is exposed out of one side of the first housing body, wherein the first audio broadcasting side is configured for facing a first ear of a user of the object;

a first error microphone, being disposed in the first housing body, and the first error microphone is exposed out of one side of the first housing body by one microphone head thereof, such that the microphone head of the first error microphone faces the first ear of the user;

a second housing body;

a plurality of second reference microphones, being disposed in the second housing body, and the plurality of second reference microphones are respectively exposed out of different sides of the second housing body by one microphone head thereof;

a second loudspeaker, being disposed in the second housing body and having a second audio broadcasting side that is exposed out of one side of the second housing body, wherein the second audio broadcasting side is configured for facing a second ear of the user;

a second error microphone, being disposed in the second housing body, and the second error microphone is exposed out of one side of the second housing body by one microphone head thereof, such that the microphone head of the second error microphone faces the second ear of the user; and a noise controlling module, being coupled to the plurality of first reference microphones, the first loudspeaker, the first error microphone, the plurality of second reference microphones, the second loudspeaker, and the second error microphone.

In the embodiment of the portable smart electronic device, the plurality of first reference microphones, the first loudspeaker, the first error microphone, the plurality of second reference microphones, the second loudspeaker, the second error microphone are all integrated with a communication unit.

In the embodiment of the portable smart electronic device, the noise controlling module is provided in an electronic device by a form of application program, library, variables, or operands, and the electronic device has a communication interface for communicating with the communication unit.

In the embodiment of the portable smart electronic device, the electronic device is selected from the group consisting of desk computer, laptop computer, server computer, smart phone, tablet PC, smart watch, Smart home appliance controlling device, and tele-care monitoring device.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein.

DETAILED DESCRIPTION OF THE PREFERRED EMBODIMENTS

To more clearly describe a portable smart electronic device for noise attenuating and audio broadcasting disclosed by the present invention, embodiments of the present invention will be described in detail with reference to the attached drawings hereinafter.

Figure 1:
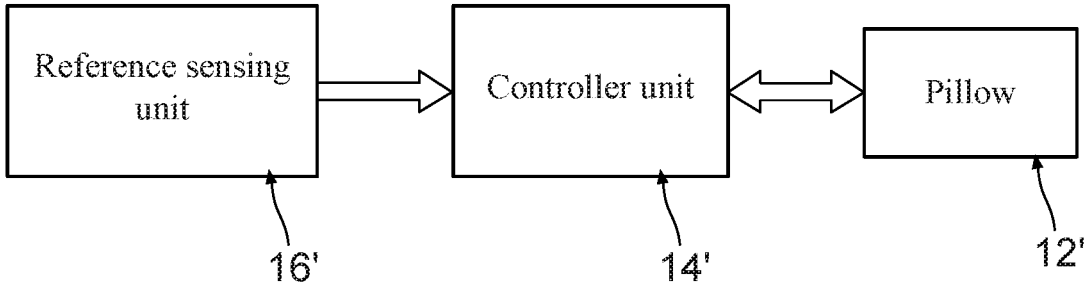
FIG. 1 (Prior Art)
FIG. 1 shows a block diagram of the electronic pillow disclosed by U.S. Pat. No. 8,325,934.
Figure 2:
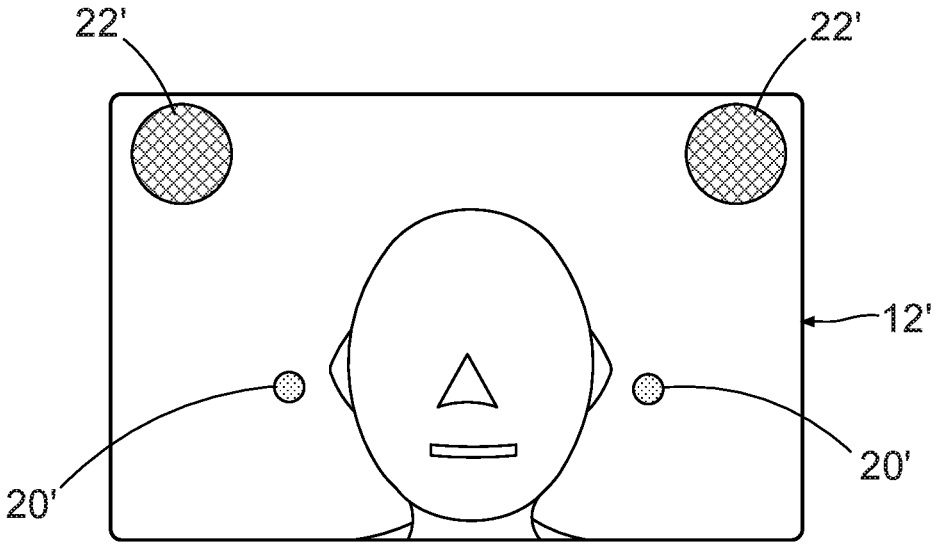
FIG. 2 (Prior Art)
FIG. 2 shows a top view of the conventional electronic pillow.
Figure 3:
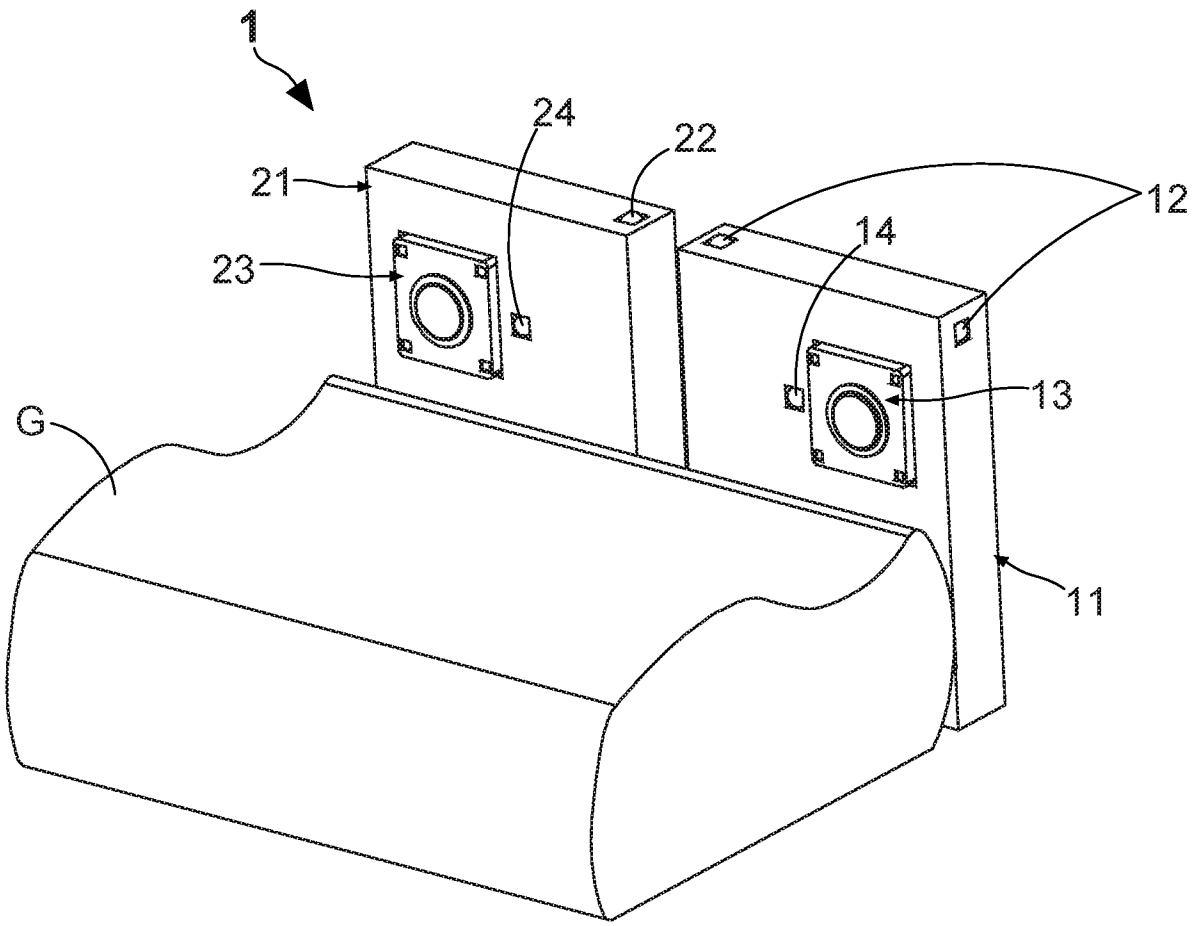
FIG. 3 shows a stereo diagram of a portable smart electronic device for noise attenuating and audio broadcasting according to the present invention.
Figure 4:
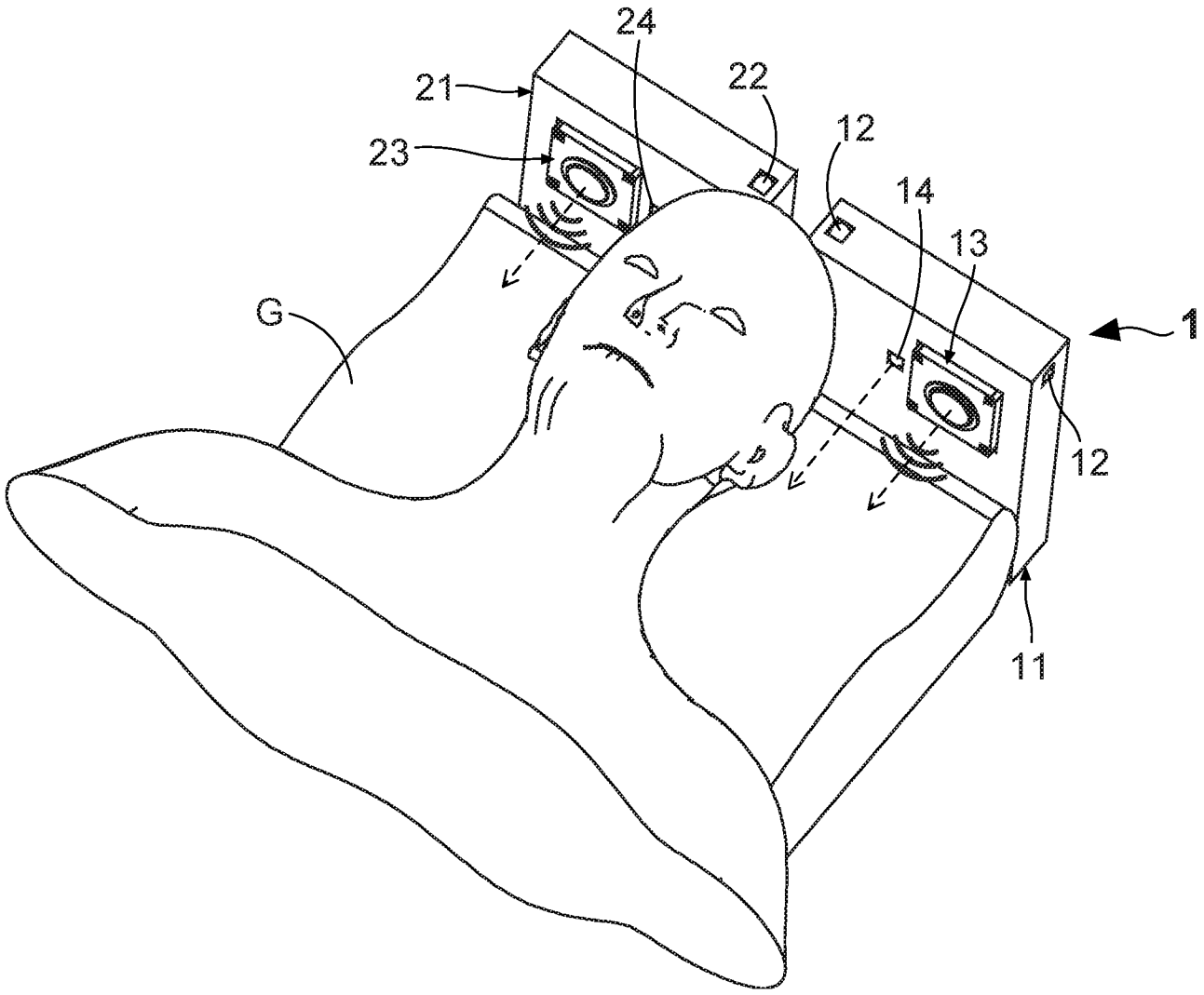
FIG. 4 shows a schematic diagram for describing the application of the portable smart electronic device of the present invention.

With reference to FIG. 3, there is shown a stereo diagram of a portable smart electronic device for noise attenuating and audio broadcasting according to the present invention. Moreover, FIG. 4 shows a schematic diagram for describing the application of the portable smart electronic device of the present invention. The portable smart electronic device 1, for noise attenuating and audio broadcasting, is used for being connected to an object G like a pillow shown as FIG. 4. However, the object G should not be limited to be a pillow, which can also be a bed, a bedside table, a bedside cabinet, a seat, a sofa, or a neck pillow. When using this portable smart electronic device 1, the head of a user would lean on the object G, such that the portable smart electronic device 1, connected to the object G, is therefore close to the head of the user. As FIG. 3 and FIG. 4 show, the portable smart electronic device 1 comprises a first housing body 11, a plurality of first reference microphones 12, a first loudspeaker 13, a first error microphone 14, a second housing body 21, a plurality of second reference microphones 22, a second loudspeaker 23, a second error microphone 24, and a noise controlling module 10.

Figure 5:
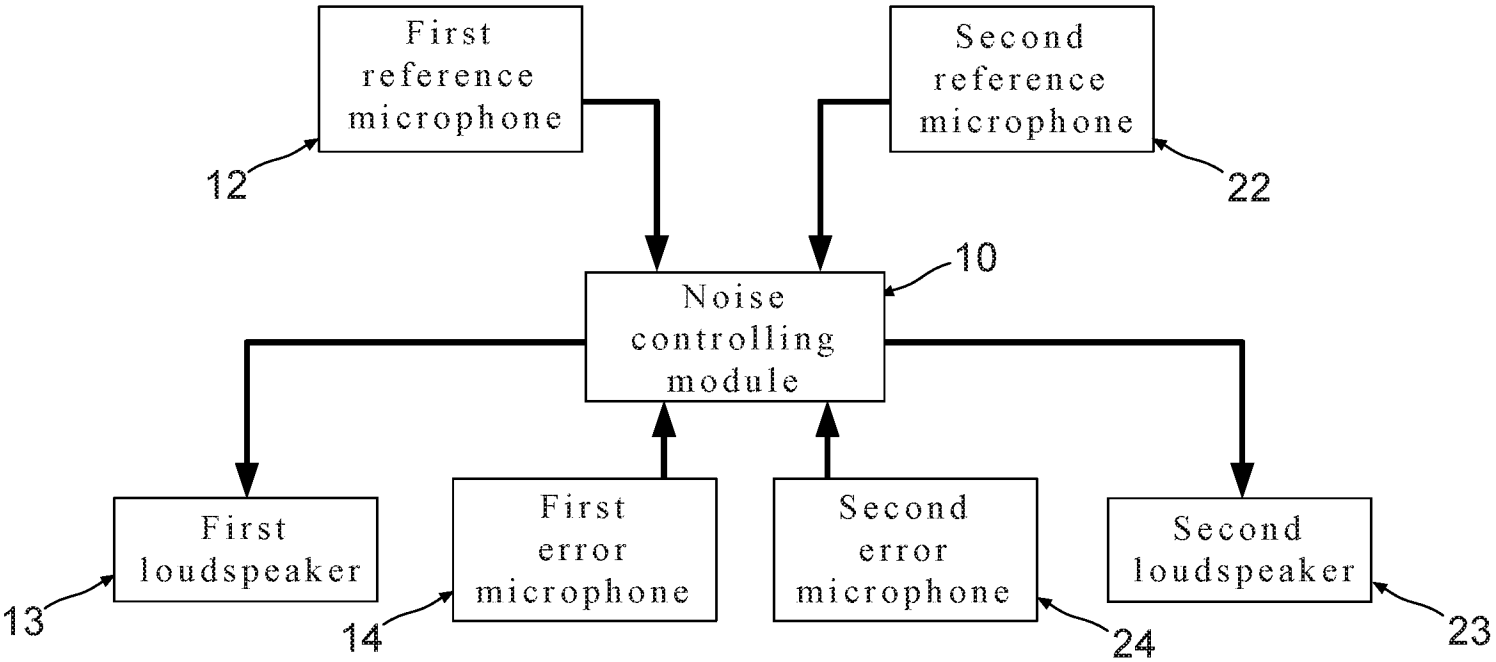
FIG. 5 shows a first block diagram of the portable smart electronic device of the present invention.

Referring to FIG. 3 and FIG. 4 again, and please simultaneously refer to FIG. 5, which illustrates a first block diagram of the portable smart electronic device of the present invention. In the present invention, the plurality of first reference microphones 12 are disposed in the first housing body 11, and the plurality of first reference microphones 12 are respectively exposed out of different sides of the first housing body 11 by one microphone head thereof. For example, FIG. 4 depicts that the first reference microphones 12 are respectively exposed out of the right side, the top side and the rear side of the first housing body 11. On the other hand, the first loudspeaker 13 is disposed in the first housing body 11 and has a first audio broadcasting side that is exposed out of one side of the first housing body 11, wherein the first audio broadcasting side is configured for facing a first ear of a user of the object G. Moreover, the first error microphone 14 is disposed in the first housing body 11, and is exposed out of one side of the first housing body 11 by one microphone head thereof, such that the microphone head of the first error microphone 14 faces the first ear of the user. Briefly speaking, both the microphone head of the first error microphone 14 and the first audio broadcasting side of the first loudspeaker 13 are exposed out of the same side of the first housing body 11, such that a noise detection direction of the first error microphone 14 and an audio broadcasting direction of the first loudspeaker 13 have a same progress direction.

As FIG. 3 and FIG. 4 show, the plurality of second reference microphones 22 are disposed in the second housing body 21, and the plurality of second reference microphones 22 are respectively exposed out of different sides of the second housing body 21 by one microphone head thereof. For instance, FIG. 4 depicts that the second reference microphones 22 are respectively exposed out of the right side, the top side and the rear side of the second housing body 21. As described in detail below, the second loudspeaker 23 is disposed in the second housing body 21 and has a second audio broadcasting side that is exposed out of one side of the second housing body 21, wherein the second audio broadcasting side is configured for facing a second ear of the user. Moreover, the second error microphone 24 is disposed in the second housing body 21, and is exposed out of one side of the second housing body 21 by one microphone head thereof, such that the microphone head of the second error microphone 24 faces the second ear of the user. Briefly speaking, both the microphone head of the second error microphone 24 and the second audio broadcasting side of the second loudspeaker 23 are exposed out of the same side of the second housing body 21, such that a noise detection direction of the second error microphone 24 and an audio broadcasting direction of the second loudspeaker 23 have a same progress direction.

From FIG. 3, FIG. 4 and FIG. 5, engineers skilled in noise attenuation or reduction technology should know that, the noise controlling module 10 can be a digital signal processor (DSP), a microprocessor, an integrated circuit (IC) comprising field programmable gate array (FPGA) or an ARM processor. In addition, FIG. 5 also depicts that the noise controlling module 10 is coupled to the plurality of first reference microphones 12, the first loudspeaker 13, the first error microphone 24, the plurality of second reference microphones 22, the second loudspeaker 23, and the second error microphone 24.

The noise controlling module 10 commonly comprises a plurality of analog-to-digital conversion unit for respectively applying corresponding signal converting processes to a plurality of first reference signals transmitted from the plurality of first reference microphones 12, a first error signal transmitted from the first error microphone 14, a plurality of second reference signals transmitted from the plurality of second reference microphones 22, and a second error signal transmitted from the second error microphone 24. Herein, it is worth further explaining that, U.S. Pat. No. 10,171,907 has disclosed that the foregoing analog-to-digital conversion unit comprises pre-amplifier, antialiasing filter and an analog-to-digital converter. Therefore, after completing the corresponding signal converting processes, a plurality of first digital reference signals, a first digital error signal, a plurality of second digital reference signals, and a second digital error signal are hence produced.

On the other hand, the noise controlling module 10 further comprises at least one digital signal processing unit for applying at least one digital process to the plurality of first digital reference signals, the first digital error signal, the plurality of second digital reference signals, and the second digital error signal, thereby making the noise controlling module 10 generate a first anti-noise signal and a second anti-noise signal based on data that are obtained after completing the at least one digital process. Subsequently, the first anti-noise signal and the second anti-noise signal are transmitted from the noise controlling module 10 to the first loudspeaker 13 and the second loudspeaker 23, respectively. As a result, the first loudspeaker 13 and the second loudspeaker 23 respectively broadcast a first anti-noise audio (sound) and a second anti-noise audio (sound) to a first region near to a right ear and a second region near to a left ear, so as to establish a quiet zone in both the two regions by attenuating various environment noises. Herein, it needs to emphasize that, since how to complete the foregoing digital processes have been taught and disclosed by U.S. Pat. Nos. 10,171,907 and 8,325,934.

Figure 6:
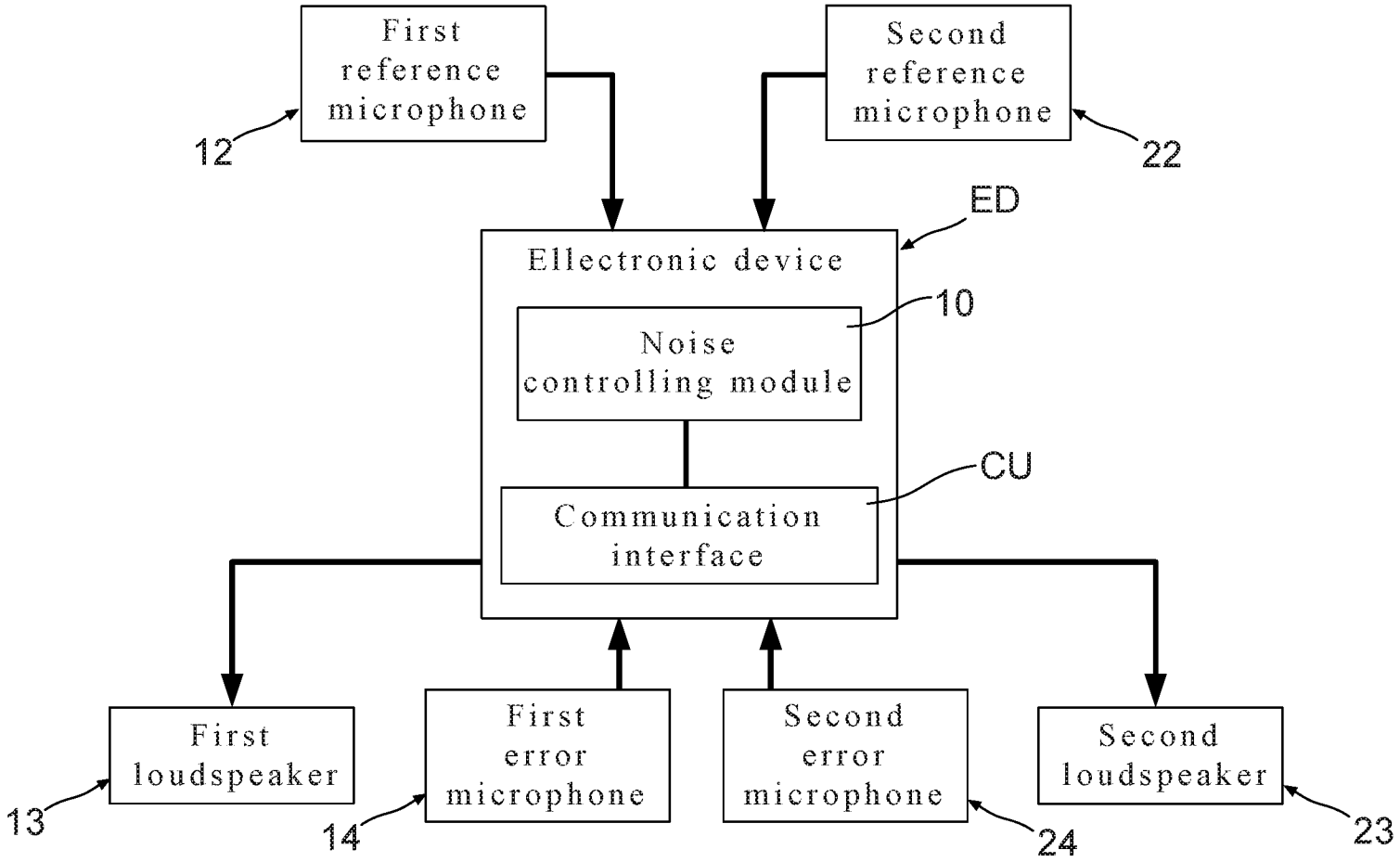
FIG. 6 shows a second block diagram of the portable smart electronic device of the present invention.
Figure 7:
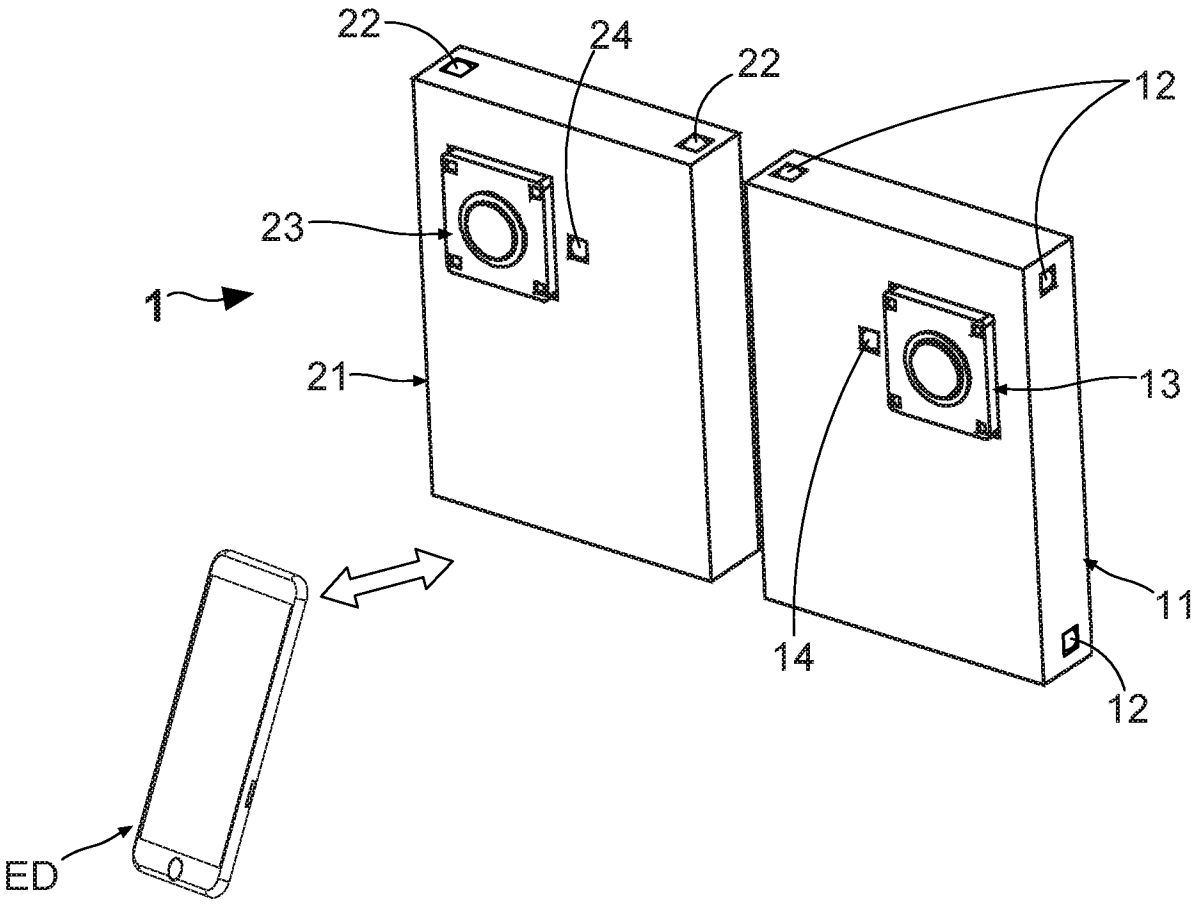
FIG. 7 shows a stereo diagram of the portable smart electronic device of the present invention and an electronic device.

FIG. 6 shows a second block diagram of the portable smart electronic device of the present invention, and FIG. 7 shows a stereo diagram of the portable smart electronic device of the present invention and an electronic device. As FIG. 6 and FIG. 7 show, the noise controlling module 10 can also be provided in an electronic device ED by a form of application program, library, variables, or operands. Moreover, in a practicable application of the portable smart electronic device 1 of the present invention, the plurality of first reference microphones 12, the first loudspeaker 13, the first error microphone 13, the plurality of second reference microphones 22, the second loudspeaker 23, the second error microphone 23 can all be integrated with a communication unit, and the electronic device ED has a communication interface CU for communicating with the communication unit.

For example, the communication interface CU and the communication unit can both be a wireless communication interface such as a Bluetooth interface or a WiFi interface. Therefore, the electronic device ED is able to receive the first reference signals transmitted from the plurality of first reference microphones 12, the first error signal transmitted from the first error microphone 14, the second reference signals transmitted from the plurality of second reference microphones 22, and the second error signal transmitted from the second error microphone 24, correspondingly produce a plurality of first digital reference signals, a first digital error signal, a plurality of second digital reference signals, and a second digital error signal. Consequently, after the related digital processes are finished, the electronic device ED generates a first anti-noise signal and a second anti-noise signal, and then transmits that to the first loudspeaker 13 and the second loudspeaker 23.

The foregoing electronic device ED can be a smart phone, a desk computer, a laptop computer, a server computer, a tablet PC, a smart watch, a smart home appliance controlling device, and a tele-care monitoring device. It is worth further explaining that, after integrating the noise controlling module 10 into the electronic device ED, this novel portable smart electronic device 1 for noise attenuating and audio broadcasting can further possesses several advanced functions, including snore cancellation, abating environment noises, noise masking, sleep apnea detection, sleeping quality detection, acoustic echo cancelation, double talk detection (DTD), voice control, and audio integration.

On the other hand, after comparing FIG. 7 with FIG. 4, it can also found that the FIG. 7 depicts that the plurality of first reference microphones 12 are disposed and distributed on different sides of the first housing body 11, and the plurality of second reference microphones 22 are also disposed and distributed on different sides of the second housing body 21. Briefly speaking, the first reference microphones 12 and the second reference microphones 12 are adopted for collecting various environment noises, so that the disposing positions of the first reference microphones 12 and the second reference microphones 12 must be fully considered so as to have a proper arrangement, in order to make this portable smart electronic device 1 completely show its noise abating function.

Therefore, through above descriptions, all embodiments and their constituting elements of the portable smart electronic device for noise attenuating and audio broadcasting proposed by the present invention have been introduced completely and clearly; in summary, the present invention includes the advantages of:

(1) The present invention describes a portable smart electronic device 1 for noise attenuating and audio broadcasting, which mainly comprises: a first housing body 11, a plurality of first reference microphone 12, a first loudspeaker 13, a first error microphone 14, a second housing body 21, a plurality of second reference microphone 22, a second loudspeaker 23, a second error microphone 24, and a noise controlling module 10. Particularly, both the first error microphone 14 and the second error microphone 24 are set to have a noise detection direction and face to a first region near to a right ear and a second region near to a left ear, respectively. Therefore, the noise detection direction and the audio broadcasting direction of both the first loudspeaker 13 and the second loudspeaker 23 have a same progress direction. By such arrangement, this portable smart electronic device 1 can be operated to adaptively provide an anti-noise audio to the first region and the second region so as to establish a quiet zone in both the two regions by attenuating various environment noises.

(2) Moreover, after being integrating the noise controlling module 10 into the electronic device ED, this novel portable smart electronic device 1 for noise attenuating and audio broadcasting can further possesses several advanced functions, including snore cancellation, abating environment noises, noise masking, sleep apnea detection, sleeping quality detection, acoustic echo cancelation, double talk detection (DTD), voice control, and audio integration.

The above description is made on embodiments of the present invention. However, the embodiments are not intended to limit scope of the present invention, and all equivalent implementations or alterations within the spirit of the present invention still fall within the scope of the present invention.

What is claimed is:

1. A portable smart electronic device for noise attenuating and audio broadcasting, being connected to an object, and comprising:

a first housing body;

a plurality of first reference microphones, being disposed in the first housing body, and the plurality of first reference microphones being respectively exposed out of different sides of the first housing body by one microphone head thereof;

a first loudspeaker, being disposed in the first housing body and having a first audio broadcasting side that is exposed out of one side of the first housing body, wherein the first audio broadcasting side is configured for facing a first ear of a user of the object;

a first error microphone, being disposed in the first housing body, and the first error microphone being exposed out of one side of the first housing body by one microphone head thereof, such that the microphone head of the first error microphone faces the first ear of the user;

a second housing body;

a plurality of second reference microphones, being disposed in the second housing body, and the plurality of second reference microphones being respectively exposed out of different sides of the second housing body by one microphone head thereof;

a second loudspeaker, being disposed in the second housing body and having a second audio broadcasting side that is exposed out of one side of the second housing body, wherein the second audio broadcasting side is configured for facing a second ear of the user;

a second error microphone, being disposed in the second housing body, and the second error microphone being exposed out of one side of the second housing body by one microphone head thereof, such that the microphone head of the second error microphone faces the second ear of the user; and a noise controlling module, being coupled to the plurality of first reference microphones, the first loudspeaker, the first error microphone, the plurality of second reference microphones, the second loudspeaker, and the second error microphone.

2. The portable smart electronic device of claim 1, wherein the noise controlling module is a digital signal processor or a microprocessor.

3. The portable smart electronic device of claim 1, wherein the noise controlling module comprises a plurality of analog-to-digital conversion unit for respectively applying corresponding signal converting processes to a plurality of first reference signals transmitted from the plurality of first reference microphones, a first error signal transmitted from the first error microphone, a plurality of second reference signals transmitted from the plurality of second reference microphones, and a second error signal transmitted from the second error microphone, so as to correspondingly produce a plurality of first digital reference signals, a first digital error signal, a plurality of second digital reference signals, and a second digital error signal.

4. The portable smart electronic device of claim 3, wherein the noise controlling module further comprises at least one digital signal processing unit for applying at least one digital process to the plurality of first digital reference signals, the first digital error signal, the plurality of second digital reference signals, and the second digital error signal, thereby making the noise controlling module generate a first anti-noise signal and a second anti-noise signal based on data that are obtained after completing the at least one digital process.

5. The portable smart electronic device of claim 4, wherein the plurality of first reference microphones, the first loudspeaker, the first error microphone, the plurality of second reference microphones, the second loudspeaker, the second error microphone are all integrated with a communication unit.

6. The portable smart electronic device of claim 5, wherein the noise controlling module is provided in an electronic device by a form of application program, library, variables, or operands, and the electronic device having a communication interface for communicating with the communication unit.

7. The portable smart electronic device of claim 6, wherein the electronic device is selected from the group consisting of desk computer, laptop computer, server computer, smart phone, tablet PC, smart watch, smart home appliance controlling device, and tele-care monitoring device.

8. The portable smart electronic device of claim 6, wherein both the communication interface and the communication unit are a wired communication interface or a wireless communication interface.

9. The portable smart electronic device of claim 1, wherein the object is selected from the group consisting of pillow, bed, bedside table, bedside cabinet, seat, sofa, and neck pillow.

* * * * *